US011639537B2

(12) United States Patent
Dubois et al.

(10) Patent No.: US 11,639,537 B2
(45) Date of Patent: May 2, 2023

(54) COOLING DEVICE FOR BLOWING GAS ONTO A SURFACE OF A TRAVELING STRIP

(71) Applicant: JOHN COCKERILL S.A., Seraing (BE)

(72) Inventors: Michel Dubois, Boncelles (BE); Michel Boyer, Chartrettes (FR)

(73) Assignee: JOHN COCKERILL S.A., Seraing (BE)

( * ) Notice: Subject to any disclaimer, the term of this patent is extended or adjusted under 35 U.S.C. 154(b) by 0 days.

(21) Appl. No.: 17/625,781

(22) PCT Filed: Dec. 20, 2019

(86) PCT No.: PCT/EP2019/086751
§ 371 (c)(1),
(2) Date: Jan. 10, 2022

(87) PCT Pub. No.: WO2021/004651
PCT Pub. Date: Jan. 14, 2021

(65) Prior Publication Data

US 2022/0251677 A1 Aug. 11, 2022

(30) Foreign Application Priority Data

Jul. 11, 2019 (EP) ..... 19185623

(51) Int. Cl.
*C21D 9/573* (2006.01)
*C22F 1/04* (2006.01)
(Continued)

(52) U.S. Cl.
CPC ..... *C21D 9/5735* (2013.01); *C21D 1/613* (2013.01); *C21D 1/62* (2013.01); *C22F 1/002* (2013.01); *C22F 1/04* (2013.01)

(58) Field of Classification Search
CPC ..... C21D 9/5736; C21D 1/613; C21D 1/62; C22F 1/002; C22F 1/04
(Continued)

(56) References Cited

U.S. PATENT DOCUMENTS 4,210,288 A * 7/1980 Dobson ..... B21B 45/0233 239/597
4,511,089 A * 4/1985 Ebata ..... B21B 45/0233 137/561 A
(Continued)

FOREIGN PATENT DOCUMENTS

EP 2540407 * 1/2013 ..... C21D 9/5735
EP 1655383 B1 3/2013
FR 2925919 A1 7/2009

*Primary Examiner* — Jessee R Roe
*Assistant Examiner* — Michael Aboagye
(74) *Attorney, Agent, or Firm* — Leydig, Voit & Mayer, Ltd.

(57) ABSTRACT

A gas blower device for blowing gas onto a surface of a traveling strip includes a plenum in the form of a hollow box for containing gas and comprising two side surfaces, a back surface and a front surface opposite to the back surface. The front surface having a profile of convex type symmetry with respect to a mid-plane perpendicular to the plane of the strip, so that a middle ridge of the front surface is located at the smallest distance from the plane of the strip. The front surface further presenting multiple tubular nozzles protruding at the front surface and having a gas outlet orifice facing in use the traveling strip. All the outlet orifices are essentially in a plane parallel to the strip plane. The gas blower device further includes a gas intake tube for feeding the plenum with gas.

18 Claims, 3 Drawing Sheets

(51) Int. Cl.
*C22F 1/00* (2006.01)
*C21D 1/62* (2006.01)
*C21D 1/613* (2006.01)

(58) Field of Classification Search
USPC ..... 266/46, 251, 113, 114, 87, 90, 259; 34/114, 570, 611; 148/611
See application file for complete search history.

(56) References Cited

U.S. PATENT DOCUMENTS

| | | | | |
|---|---|---|---|---|
| 4,625,431 | A | 12/1986 | Nanba et al. | |
| 6,054,095 | A | 4/2000 | Minato et al. | |
| 6,309,483 | B1 * | 10/2001 | Wang | C21D 9/562 148/661 |
| 8,480,949 | B2 * | 7/2013 | Kobayashi | C21D 9/5735 266/251 |
| 8,591,675 | B2 * | 11/2013 | Muller | B21B 45/0218 148/661 |
| 8,771,588 | B2 * | 7/2014 | Langevin | C21D 9/46 266/251 |
| 2002/0124916 | A1 | 9/2002 | Pasquinet et al. | |
| 2005/0262723 | A1 | 12/2005 | Yamashita | |
| 2007/0241485 | A1 | 10/2007 | Boyer et al. | |
| 2010/0269367 | A1 * | 10/2010 | Langevin | C21D 9/46 34/611 |
| 2011/0018178 | A1 | 1/2011 | Muller et al. | |
| 2018/0245173 | A1 | 8/2018 | Brumayer et al. | |

* cited by examiner

COOLING DEVICE FOR BLOWING GAS ONTO A SURFACE OF A TRAVELING STRIP

CROSS-REFERENCE TO PRIOR APPLICATIONS

This application is a U.S. National Phase application under 35 U.S.C. § 371 of International Application No. PCT/EP2019/086751, filed on Dec. 20, 2019, and claims benefit to European Patent Application No. EP 19185623.6, filed on Jul. 11, 2019. The International Application was published in English on Jan. 14, 2021 as WO 2021/004651 under PCT Article 21(2).

FIELD

The present invention relates to a cooling device for blowing gas onto the surface of a traveling strip, preferably a metal strip. The invention particularly relates to a gas blower device allowing to obtain an improved temperature uniformity of the strip in the passage through the cooling device.

The present invention is particularly applicable in technical fields involving industrial lines for processing steel or aluminium strips, where at least one cooling chamber is used, such as thermal processing lines or coating lines, in particular continuous annealing lines or galvanization lines.

BACKGROUND

In thermal processing lines or coating lines, and in other fields where a metal strip has to be cooled, it is known to use gas blower devices for blowing gas onto one or both faces of a traveling metal strip, in order to cool said metal strip. Moreover there is a constant need of improving the stability and the temperature uniformity of the traveling strip in order to always obtain a better finished product.

Driven by carbon dioxide ($CO_2$) reduction in vehicle manufacturing, steel producers and car designers are requesting for very high strength steels, allowing to reduce the weight of the vehicles but also having some plastic elongation. In practice, the current market requires steels with fully martensitic grades as well as complex phases and quench, and partitioning structures. Furthermore the steel alloy elements have to be strongly limited to ensure reliable spot welding but also to reduce steel manufacturing costs. In these conditions, it is required to provide a high cooling rate down to the martensite-start temperature (Ms temperature) as well as an accurate and uniform temperature at the end of the process, as the grades specified here above require that only a part of the austenite be transformed in martensite.

It is also well known that gas cooling requires a high level of turbulence on the strip surface to reduce the thickness of the boundary layer. This means that the amount of blown gas per square meter and its speed should increase with the desired cooling rate. Consequently, the electrical consumption needed to circulate the cooling gas is high, which has an impact on the operating costs.

The classical way for cooling a strip, in continuous annealing lines for example, is to use nozzles to drive a cold gas on the strip. Mostly, the present gas blower devices comprise two hollow boxes or headers, each provided with a plurality of nozzles directed towards a face of the strip. The nozzles can either be slots provided in the boxes, or rounded tubular nozzles. These could also be of various shapes, not only strictly "rounded", but also squared or even with more exotic shape.

It is also known that, for a defined heat transfer coefficient, tubular nozzles require less energy (estimated by the product of gas flow by inlet pressure).

Document US 2011/018178 A1 discloses a device comprising at least one distribution chamber with tubular nozzles for providing a plurality of jets of gas. The aim of this document is to provide a system for acting on the temperature of a travelling strip by blowing a gas or a water/gas mixture, as well as inducing limited vibrations of the strip in the passage through the cooling or heating region, even at high blowing pressures. The nozzles are arranged in such a way that the impacts of the jets of gas on the surface of the strip are distributed at the nodes of a two-dimensional network, and that the impacts of the jets on one face of the strip are not opposite the impacts of the jets on the other face. The jets of gas or water/gas mixture may be perpendicular to the surface of the strip, or may form an angle with the normal to the surface of the strip. The nozzles extend at a distance from the distribution chamber in such a way as to leave a free space for the flow of the returning gas or water/gas mixture into directions parallel to the strip plane.

Document U.S. Pat. No. 6,054,095 A describes a cooling system for cooling a strip in a vertical path of a continuous strip heat-treating process, in which cooling nozzles are provided on the surfaces of cooling headers arranged closely opposed to both surfaces of the strip. Each cooling nozzle is inclined in such a manner that a center line of a jet is inclined with respect to a normal line at a position on the strip surface.

Document EP 1 655 383 B1, referring to a device named by the inventors "BLOWSTAB® 1", relates to a method and a device, for improving the capacity or quality of cooling in a gas-blown cooling chamber or of an air-blown cooling section of a heat treatment line for steel or aluminum and/or improving the quality of the products by reducing the vibrations generated by the cooling. Jets of gas or air are thrown towards each of the faces of the strip moving in said chamber or section. The jets of gas or air are emitted from blowing tubes fitted to tubular nozzles arranged at a distance from each other transversely to the direction of movement of the strip, said jets being directed towards the relevant face of the strip by being inclined both substantially towards the edges of said strip in a plane perpendicular to the plane of the strip and to the direction of movement of the strip, and upstream or the downstream of a strip in a plane perpendicular to the plane of the strip and parallel to the direction of movement of the strip.

Due to the high flow per square meter of metal sheet, the evacuation of the gas after having hit the strip must not be constrained. If it is not the case, the strip may flutter due to the pressure generated between the plenum and the strip. To this end various designs have been proposed. In particular the design presented in document FR 2 925 919 A1 (named hereinafter "BLOWSTAB® 2") is very efficient and permits to significantly improve the evacuation of the gas outside of the blower device, laterally following a pathline between the tubes. It was shown that this design leads to a significant reduction of strip vibrations but also of the electrical consumption for a defined heat removal. The BLOWSTAB® 2 design disclosed in document FR 2 925 919 A1 is a device for blowing gas onto a face of a traveling strip, comprising at least one plenum (or hollow box) fitted with a plurality of tubular nozzles directed towards a face of the strip. On the side directed to the face of the strip, the hollow box presents a surface of profile P that varies in at least one given direction symmetrically about a mid-plane perpendicular to the plane of the strip and parallel to the direction of movement of the strip. Preferably, the profile P is varying according to the direction transverse to the traveling direction of the strip and is convex, seen from the strip, in order to favour an uniform transverse speed of the blown gas. More preferably the profile P is a dihedral profile but can be more generally a convex profile with rounded flanks. The nozzles are fastened with their roots to the varying-profile surface in such a manner that their respective axes are essentially orthogonal to said varying profile at the connection points. Furthermore, the nozzles have respective lengths that are selected so that the outlet orifices lie in a common plane substantially parallel to the plane of the strip.

In the design of BLOWSTAB® 2, the low level of strip vibration for a defined heat removal is related to the general design of the plenum supplying the various tubes as well as the selected tube length. With such a design, the gas can escape laterally without constraint thanks to the high cross-section available. In addition, due to the tilted impact of the gas flow on the steel strip, the gas blow follow a very stable path. In case the gas is blown perpendicular to the sheet, the flow becomes unstable due to the full symmetry of the situation. Therefore, owing to those two features, the pressure generated between the plenum and the strip is very low and not fluctuating. It results in that the excitation source of strip vibration disappears.

Unfortunately, some experiments have shown that this device presents a number of drawbacks. The BLOWSTAB® 2, when used after annealing to cool the strip down to 500-150° C., shows a poor temperature uniformity of the strip as well as a limiting cooling capacity. Differences of temperature higher than 10° Celsius (C) have been observed on the width of the strip. Regarding the cooling rate, a maximum of 60° C./sec on 1 mm thickness can be reached with 5% $H_2$ mixed in an inert gas, typically $N_2$. It is also observed that the cooling rate on the edges is lower than in the centre, which leads to a hotter temperature at the edges than at the centre of the strip. This further leads to a non-uniform tension across the width of the strip as the hot parts are longer than the cold ones. Therefore, the edges may vibrate easier because they have a very low tension, in addition to the fact that due to the length difference they form a wavy shape. Moreover, the amplitude of the wave increases with the difference of temperatures on the width of the strip.

SUMMARY

In an embodiment, the present invention provides a gas blower device for blowing gas onto a surface of a traveling strip, comprising: a plenum in the form of a hollow box for containing gas and comprising two side surfaces, a back surface and a front surface opposite to the back surface, the front surface having a profile of convex type, symmetric with respect to a mid-plane perpendicular to the plane of the strip, so that a middle ridge of the front surface is located at the smallest distance from the plane of the strip, the front surface further presenting a plurality of tubular nozzles protruding at the front surface and having a gas outlet orifice facing in use the traveling strip, all the outlet orifices being essentially in a plane parallel to the strip plane; a gas intake tube for feeding the plenum with gas; wherein all the tubular nozzles have the same length, the length being defined as the length between the gas inlet and the gas outlet of a nozzle, so that the root or the inlet of the tubular nozzles is inevitably located inside the plenum, the tubular nozzles passing without connection through an orifice inside the front surface, and having the root connected to an internal connection plate within the plenum.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
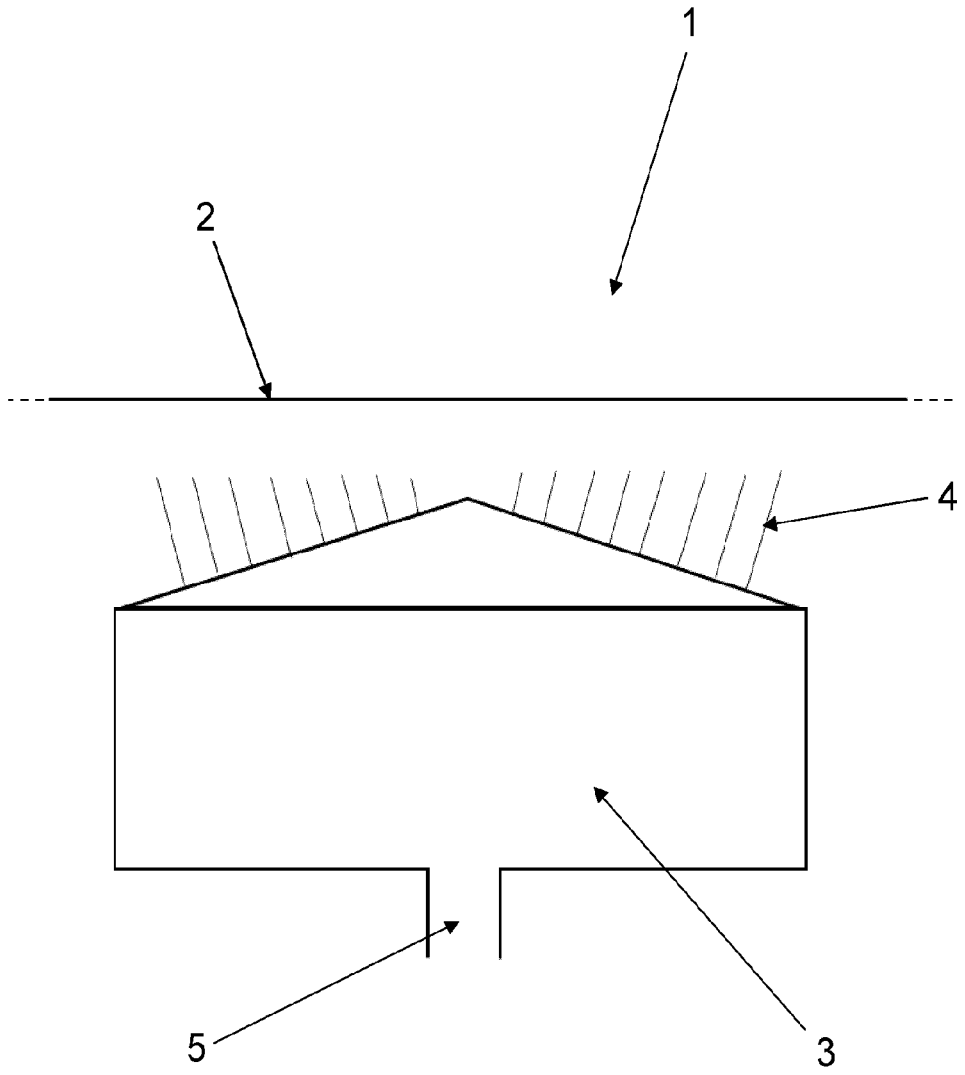
FIG. 1 (PRIOR ART)
FIG. 1 schematically represents a common gas blowing device of prior art (such as BLOWSTAB® 2)

In some embodiments, the present invention provides a gas blower device that does not present the drawbacks of the above-mentioned prior art systems, and that optimizes both the thermal and air-flow aspects of blowing, while minimizing the vibration of the strip during traveling.

In some embodiments, the present invention provides a gas blower device suitable to annealing lines in the case of manufacturing of recent very high strength steels, requiring very high cooling rates.

In some embodiments, the present invention obtains an improved temperature uniformity of the traveling strip in the passage through the cooling device. In some embodiments, the present invention provides a cooling device allowing to obtain an improved thermal gradient along the width of the strip, while keeping a good disposal of the blown gas to minimize the vibrations of the strip in order to obtain a better finished product and a limited electrical consumption.

The present invention firstly relates to a gas blower device for blowing gas onto a surface of a traveling strip, comprising:

a plenum in the form of a hollow box for containing gas and comprising two side surfaces, a back surface and a front surface opposite to the back surface, the front surface having a profile of convex type, symmetric with respect to a mid-plane perpendicular to the plane of the strip, so that a middle ridge of said front surface is located at the smallest distance from the plane of the strip, the front surface further presenting a plurality of tubular nozzles protruding at the front surface and having a gas outlet orifice facing in use the traveling strip, all the outlet orifices being preferably in a plane parallel to the strip plane;

a gas intake tube for feeding the plenum with gas;

characterised in that all the tubular nozzles have the same length, said length being defined as the length between the gas inlet and the gas outlet of a nozzle, so that the root or the inlet of the tubular nozzles is inevitably located inside the plenum.

According to preferred embodiments of the invention, the device further includes one of the following features or by a suitable combination thereof:

the profile of convex type is a dihedral profile or a profile with lateral rounded flank;

the middle ridge of said front surface is parallel or tilted with respect to the traveling direction of the strip;

the slope of each face of the dihedral profile of the front surface has an angle comprised between a value tending asymptotically to 0° and 30° with respect to the plane of the strip, preferably between 5° and 30°, and more preferably between 5° and 15°;

a minimal slope of each face of the dihedral profile of the front surface is 5 mm/meter;

the nozzles pass without connection through an orifice inside the front surface and have a root connected to an internal connection plate within the plenum;

the nozzles protruding at the front surface have their longitudinal axes inclined towards the exterior of the device;

the nozzles have their longitudinal axes parallel among themselves on a same side of the dihedral profile;

the nozzles have their longitudinal axes perpendicular to a same side of the dihedral profile;

the nozzles have their longitudinal axes inclined about the normal of a same side of the dihedral profile;

the spacing between adjacent nozzles is comprised between 50 mm and 200 mm, preferably between 50 mm and 140 mm;

the diameter of the nozzles is comprised between 10 mm and 25 mm, preferably between 10 mm and 16 mm;

the length of the nozzles is comprised between 150 mm and 600 mm, preferably between 250 mm and 450 mm, according to the width of the plenum;

the spacing between the intersections of adjacent nozzles with the plenum is variable, in order to have a constant pitch of the gas impingement points on the strip;

the nozzles are tubular and the inlet orifices of said nozzles present a free end with a conically flaring bore;

the longitudinal axes of the nozzles are orthogonal relative to the convex front surface;

the longitudinal axes of the nozzles are orthogonal relative to the plane of the traveling strip;

the plenum is divided along its width into different sections, using separating plates, in order to allow adjustment of the gas flow rate in each of said sections;

the plenum comprises reinforcement or stiffening parts to limit variation of the plenum geometry due to internal pressure of the blowing gas.

In some embodiments, the present invention also relates to a cooling installation comprising two gas blower devices as disclosed above, characterised in that, in use, the strip is traveling between the plenums of the two gas blower devices, so that gas is blown simultaneously against both faces of the traveling strip.

In the drawings, the traveling direction of the metal strip is perpendicular to the plane of the figure.

DESCRIPTION OF PREFERRED EMBODIMENTS OF THE INVENTION

After detailed simulations and analyses, the present invention solves the problem of non-uniform strip temperature at the exit of the cooling section of the BLOWSTAB® 2 design was due to the variation in the length of the nozzles. For a defined pressure in the plenum, the mass flow decreases with the tube length. This means that, for a same plenum pressure, the central nozzles have a higher Reynolds number than those located at the edges. Therefore, the cooling efficiency is worse at the edges of the strip than in the centre.

The present invention permits to avoid a non-uniformity of the strip temperature at the exit of the cooling section. To this end, and as illustrated by FIGS. 2 and 3, the cooling device 1 of the present invention comprises a plurality of nozzles 4, provided in a plenum 3 supplied with gas, having the same length, said plenum being designed as in BLOWSTAB® 2.

According to a preferred embodiment, the plenum 3 of the present invention is in the form of a hollow box comprising two side surfaces 31, a back surface 32 and a front surface 33. The back surface 32 is connected to a blowing gas intake tube 5 and the front surface 33, opposite to the back surface 32, is provided with the plurality of nozzles 4.

The front surface 33 is considered as the active surface because it is facing the traveling strip 2. Generally any convex surface will be taken in consideration under the scope of the invention, in order to provide a more uniform transverse speed to the blown gas. Usually this surface 33 can present a simple dihedral profile, said profile being preferably considered according to a transverse direction with respect to the direction of movement of the strip (the profile could also be considered with respect of the direction of movement of the strip). The dihedral profile is symmetric and of convex type so that the middle or median ridge 34 of this surface 33 corresponds to the smallest distance to the plane of the strip 2. This specific geometry allows to reduce the strip vibrations due to an improved disposal of the high flow of gas, as the gas can escape laterally without constraint thanks to the high cross section available. The median (or middle) ridge 34 can be parallel to the traveling direction of the strip. However, according to some embodiments, the median ridge 34 can be tilted by 2-3 degrees about the traveling direction of the stip. This allows to prevent any alignment of the nozzles with the traveling direction.

Figure 2:
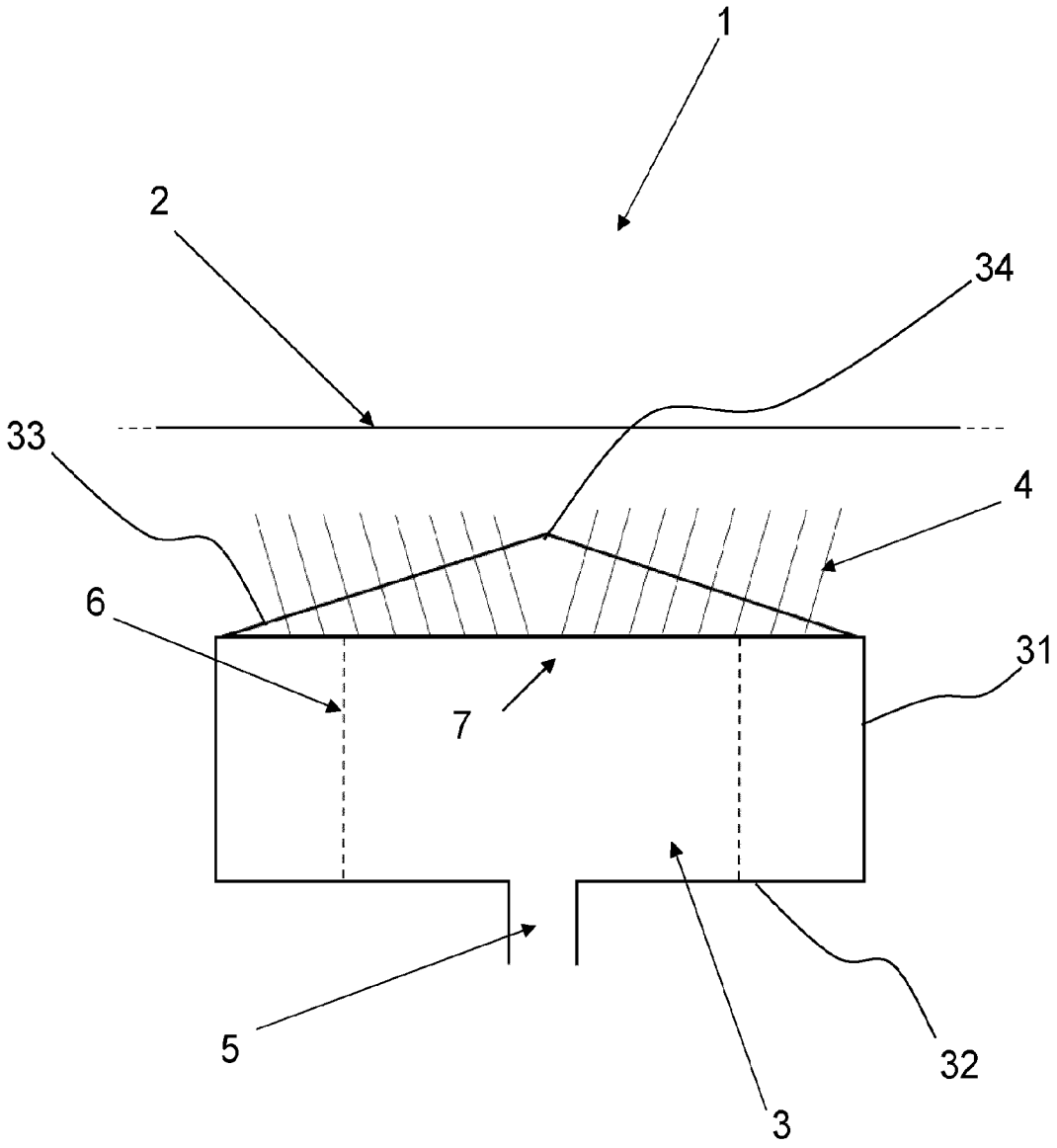
FIGS. 2 and 3 schematically represent particular embodiments for a cooling device intended to blow gas on a traveling strip according to the present invention.
Figure 3:
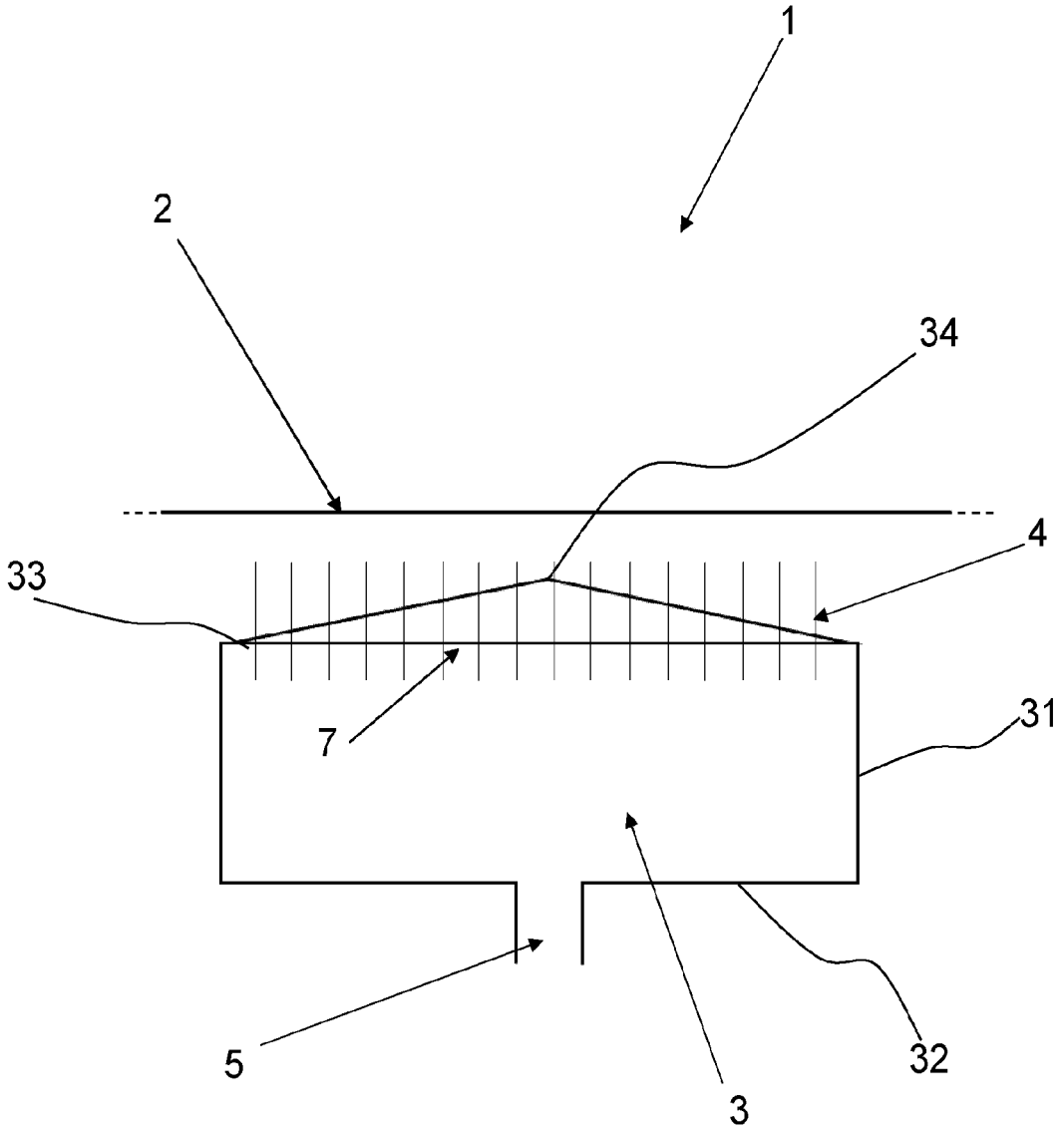

According to the invention, the plurality of nozzles 4, being provided in the front surface 33, have a same length, as illustrated in FIGS. 2 and 3. In this way, a same tube length is used across the whole width of the plenum which allows a cooling efficiency essentially identical in the middle and at the edges of the strip. This design leads to a uniform strip temperature at the exit of the cooling section because the mass flow is constant and the Reynolds number is identical in all parts of the device, when the gas hits the strip.

Preferably, the distance provided between the outlet orifices of nozzles 4 and the traveling strip 2 has to be identical across the entire width of the strip. That is to say that all the outlet orifices of nozzles 4 can lie in a common plane that is substantially parallel to the plane of the strip 2. It could also not be the case if any compensating effect is to be sought. This is then advantageous for good stabilization while said strip 2 is traveling, and also for temperature uniformity in said strip 2. The equal distances between all the nozzle orifices and the plane of the strip 2 maintain the uniformity of the pressure exerted by the gas blown onto the strip 2. In order to obtain this specific feature, in combination with the dihedral profile of the front surface 33 and in combination with the same length of the nozzles 4, the nozzles 4 may have to pass through the front surface 33, as illustrated by FIGS. 2 and 3. This is not the case in the BLOWSTAB® 2, and in the installations of prior art, where each tubular nozzle is fastened, in particular welded, via its root to the external surface of the plenum.

In some embodiments, at least part of the longitudinal axes of the nozzles 4 are parallel between them, this part corresponding for example to all the nozzles 4 located on a same side of the dihedral profile. Note that the longitudinal axis of the nozzle is the cylinder axis in case of a tubular nozzle. In the embodiment represented in FIG. 2, the longitudinal axes of the nozzles 4 are orthogonal relative to the front surface 33 (and thus to the dihedral profile). In another embodiment, represented in FIG. 3, the longitudinal axes of each nozzle 4 are orthogonal relative to the plane of the traveling strip 2 but not to the sides of the dihedral profile.

In the embodiments of the present invention, the nozzles are preferably not welded to the external surface of the plenum 3. In this case the nozzles are passing through the front surface 33 and are for example fastened to an internal plate 7 at right angle. Avoiding welding to the dihedral profile makes manufacturing easier, because welding tubes with a wall thickness typically of about 2 mm on a sheet of thickness typically of about 4 mm is very complicated.

Preferably, the slope of each face of the dihedral profile of the front surface 33 has an angle comprised between a value possibly tending asymptotically to 0° and 30° to the plane of the strip 2, preferably between 5° and 30°, and more preferably between 5° and 15°.

Advantageously, two plenums 3 are provided in a cooling installation, between which the strip 2 can travel, so that gas can be blown simultaneously against both faces of the traveling strip 2. Preferably, the two plenums 3 have their respective front surfaces 33 in a convex dihedral shape and are symmetric about the plane of the strip 2.

According to one embodiment, the spacing or pitch between adjacent nozzles 4 can vary between 50 mm and 200 mm, preferably between 50 mm and 140 mm. However, the spacing between the intersections of adjacent nozzles 4 within the plenum 4 can be variable, in order to guarantee a uniform pitch of the gas impingement points on the strip.

It is also advantageous to provide nozzles 4 which are tubular. Preferably, the nozzle diameter is comprised between 10 mm and 25 mm, and more preferably between 10 mm and 16 mm. Preferably, the tube length of the tubular nozzles is comprised between 50 mm and 600 mm, more preferably between 250 mm and 450 mm, according to the width of the plenum. A range of length values is required to compensate for the tilted shape of the plenum.

Preferably, the inlet orifice of each tubular nozzle 4 presents a free end with a conically flaring bore. These features provide substantial advantages given the reduction of head loss.

The width of the plenum 3 can also be divided into different sections, using separating plates 6 (see FIG. 2). The flow rate in each of the sections can then be adjusted either by a separate fan or by registers in the case of a single fan supply. The separating plates 6 are also advantageous in order to stiffen the structure.

The plenum 3 can also comprises an internal plate 7 as illustrated by FIG. 2, able to maintain and rigidify the two faces of the dihedral profile (front face 33), in addition to a role of attaching the nozzles (see above).

FIG. 3 is an example of design which allows to reach a heat transfer coefficient of 650 $W/m^2/°$ K, when using a gas comprising 15% $H_2$ and a nozzle to strip distance of 60 mm. The outside tube length is 100 mm in the centre of the front surface 33 and 350 mm on the edges of the front surface 33 while all the tube lengths are equal.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SYMBOLS

1 Cooling device (gas blowing device)
2 Strip
3 Plenum (or cooling header, hollow box)
31 Side surface of the plenum
32 Back surface of the plenum
33 Front surface of the plenum
34 Middle ridge of the front surface
4 Nozzle
5 Blowing gas intake tube
6 Separating plate
7 Internal connection plate

The invention claimed is:

1. A gas blower device for blowing gas onto a surface of a traveling strip, comprising:

a plenum in the form of a hollow box for containing gas and comprising two side surfaces, a back surface and a front surface opposite the back surface, the front surface having a convex type profile, symmetric with respect to a mid-plane perpendicular to a plane of the strip, so that a middle ridge of the front surface is located at a smallest distance from the plane of the strip, the front surface further presenting a plurality of tubular nozzles protruding at the front surface and having a gas outlet orifice facing the traveling strip, all the outlet orifices being essentially in a plane parallel to the strip plane;

a gas intake tube for feeding the plenum with gas;

wherein all the tubular nozzles have the same length, the length being defined as a distance between the gas intake tube and the gas outlet orifice of each one of the plurality of tubular nozzles, so that a root or an inlet of each one of the plurality of tubular nozzles is located inside the plenum, each of the plurality of tubular nozzles passing without connection through an orifice inside the front surface, and having the root directly connected at a right angle to an internal connection plate within the plenum.

2. The device according to claim 1, wherein the profile of convex type is a dihedral profile or a profile with lateral rounded flanks.

3. The device according to claim 1, wherein the middle ridge of the front surface is parallel or tilted with respect to the traveling direction of the strip.

4. The device according to claim 2, wherein a slope of each face of the dihedral profile of the front surface has an angle tending asymptotically to 0° and 30° with respect to the plane of the strip.

5. The device according to claim 2, wherein a minimal slope of each face of the dihedral profile of the front surface is 5 millimeters per meter (mm/meter).

6. The device according to claim 1, wherein the nozzles protruding from the front surface have their longitudinal axes inclined towards an exterior of the device.

7. The device according to claim 2, wherein the nozzles have their longitudinal axes parallel among themselves on a same side of the dihedral profile.

8. The device according to claim 7, wherein the nozzles have their longitudinal axes perpendicular to a same side of the dihedral profile.

9. The device according to claim 7, wherein the nozzles have their longitudinal axes inclined about the normal of a same side of the dihedral profile.

10. The device according to claim 1, wherein the spacing between adjacent nozzles is between 50 millimeters (mm) and 200 mm.

11. The device according to claim 1, wherein the diameter of the nozzles is between 10 millimeters (mm) and 25 mm.

12. The device according to claim 1, wherein the length of the nozzles is between 150 millimeters (mm) and 600 mm.

13. The device according to claim 1, wherein a spacing between intersections of adjacent nozzles with the plenum is variable, in order to have a constant pitch of gas impingement points on the strip.

14. The device according to claim 1, wherein the nozzles are tubular and that the inlet orifices of the nozzles present a free end with a conically flaring bore.

15. The device according to claim 1, wherein the longitudinal axes of the nozzles are orthogonal relative to the convex front surface.

16. The device according to claim 1, wherein the longitudinal axes of the nozzles are orthogonal relative to the plane of the traveling strip.

17. The device according to claim 1, wherein the plenum is divided along its width into different sections, using separating plates, in order to allow adjustment of a gas flow rate in each of the sections.

18. A cooling installation comprising two gas blower devices according to claim 1, such that when in use, the strip travels between two plenums of two gas blower devices which blow simultaneously against both faces of the traveling strip.

* * * * *